United States Patent [19]

Jackson

[11] Patent Number: 4,774,727

[45] Date of Patent: Oct. 4, 1988

[54] FRUIT PICKING GLOVE

[76] Inventor: Grant W. Jackson, Star Rte. Box 20, Prescott, Wash. 99348

[21] Appl. No.: 74,021

[22] Filed: Jul. 16, 1987

[51] Int. Cl.[4] ..... A41D 19/00

[52] U.S. Cl. ..... 2/161 R; 2/161 A; 2/168; 2/159

[58] Field of Search ..... 2/161 R, 161 A, 159, 2/163, 167, 168, 169

[56] References Cited

U.S. PATENT DOCUMENTS

| | | | |
|---|---|---|---|
| 133,319 | 11/1872 | Kehoe . | |
| 308,863 | 12/1884 | Worley . | |
| 745,088 | 11/1903 | Winkler . | |
| 1,612,822 | 1/1927 | Jones | 2/161 R |
| 1,911,500 | 5/1933 | Gowdy et al. . | |
| 1,979,130 | 10/1934 | Wiley | 2/168 |
| 2,694,029 | 11/1954 | Skinner | 2/168 X |
| 2,722,706 | 11/1955 | Chopp | 2/161 R X |
| 3,096,523 | 7/1963 | Bruchas | 2/159 |
| 3,098,237 | 7/1963 | Slimovitz . | |
| 4,051,553 | 10/1977 | Howard | 2/161 A |
| 4,071,913 | 2/1978 | Rector | 2/161 A X |
| 4,507,807 | 4/1985 | Karkaner . | |

*Primary Examiner*—Louis K. Rimrodt
*Assistant Examiner*—J. L. Olds
*Attorney, Agent, or Firm*—Brady, O'Boyle & Gates

[57] ABSTRACT

A fruit picking glove comprised of soft material, such as jersey, and having four finger stalls and a thumb stall. The inside end portions of the three inner finger stalls include external foam rubber pads in the region of the distal phalanges of a hand inserted into the glove while the thumb stall includes a pad of foam rubber covering the distal and proximal phalanges. The finger stall of the little finger in its preferred form does not include a pad of foam rubber on the inner or palm portion of the finger stall, but can be included when desired. Such a glove configuration permits fruit, particularly apples, to be hand picked from a tree without any bruising of the fruit while still enabling the picker to feel and quickly remove the fruit during the harvesting thereof.

8 Claims, 2 Drawing Sheets

FRUIT PICKING GLOVE

BACKGROUND OF THE INVENTION

This invention relates generally to work gloves and more particularly to gloves worn during the course of fruit picking such as the picking of apples.

While various types of gloves are known having elements applied to the fingers and thumbs for preventing wear or better frictional gripping, they are unable to be utilized in the picking of fruit without bruising same. Apples, in particular, are easily bruised when being hand picked from trees in a grove where fruit pickers must operate quickly yet carefully in order to obtain a high yield of marketable product.

Accordingly, it is an object of the present invention to provide an improvement in work gloves.

It is yet another object of the invention to provide an improvement in gloves utilized for the picking of fruit.

And yet a further object of the invention to provide a simple yet extremely effective glove which can be worn by fruit pickers for the prevention of bruises to the fruit, particularly apples, during a hand-picking harvesting procedure.

SUMMARY

Briefly, the foregoing and other objects of the present invention are fulfilled by a glove, typically worn in pairs, comprised of a body portion and a wrist cuff attached thereto. The body portion includes back hand and palm sections comprised of soft material such as jersey, which are sewn together to define a thumb stall and four finger stalls. The inside end portions of the thumb stall and the three inside finger stalls for the second, third and fourth digit of the hand are provided with a pad of foam rubber typically 0.25 in. thick which extends from the tip of the stalls inwardly toward the palm. The foam rubber pads for three finger stalls extend inwardly to the region of the joint of the distal and medial phalanges of the second, third and fourth digit of the wearer's hand while a foam rubber pad of the thumb stall extends from the tip inwardly to cover substantially both the distal and proximal phalanges of the first digit or thumb. Such a configuration enables the wearer to pick fruit quickly and easily without bruising the fruit as a result of the pressure being exerted thereon by picker's fingers during the picking process. Although not essential, the finger stall for the fifth digit or little finger can, when desirable, also include a section of foam rubber material similar to the three inner finger stalls.

BRIEF DESCRIPTION OF THE DRAWINGS

The objects of the present invention and the attendant advantages thereof will become readily apparent by the reference to the following drawings wherein like reference numerals refer to like parts, and wherein.

DETAILED DESCRIPTION OF THE INVENTION

Figures 1, 2A, 2B:
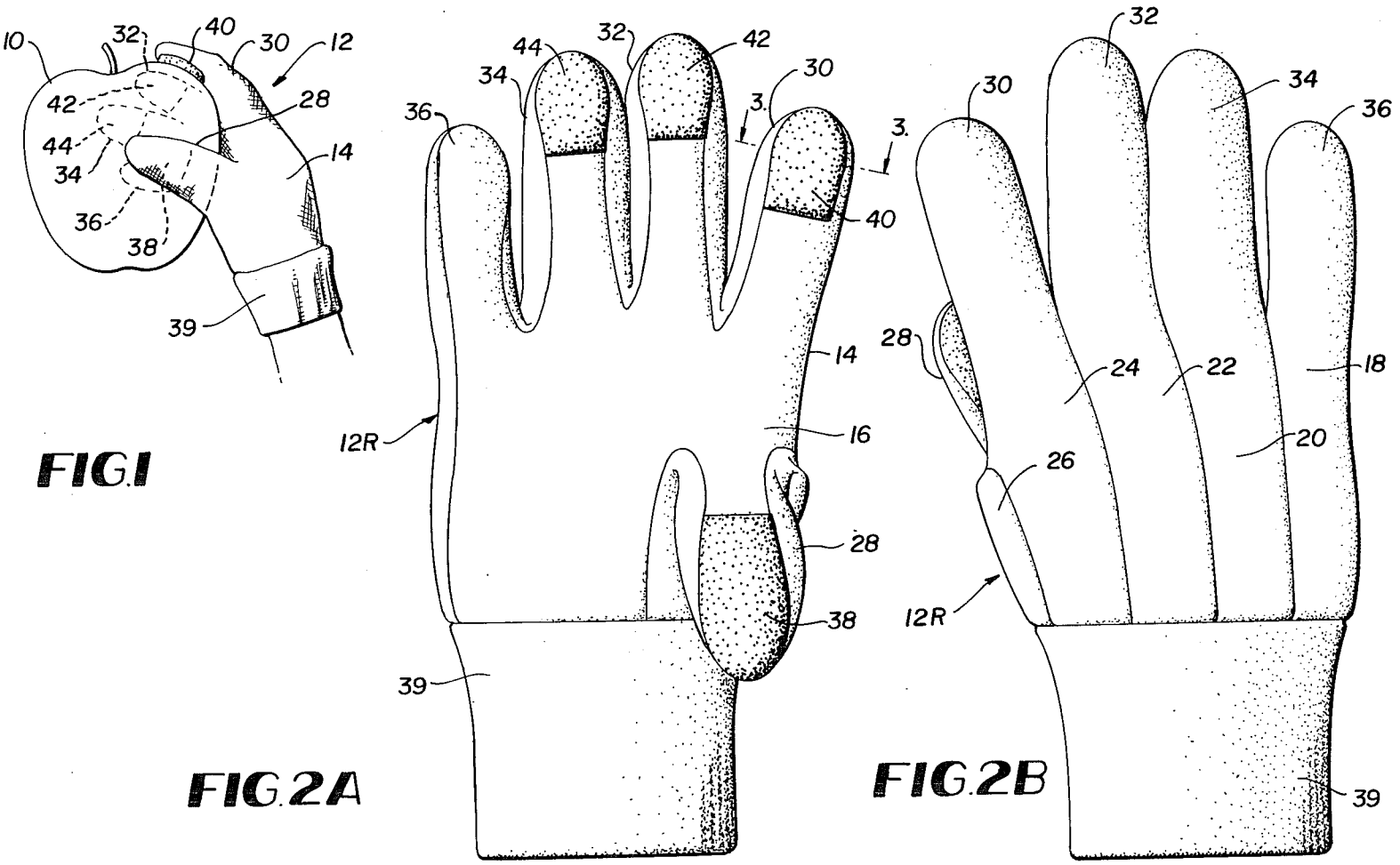
FIG. 1 is a partial front plan view illustrative of a glove in accordance with the subject invention utilized in the course of picking of a piece of fruit such as an apple.
FIGS. 2A and 2B are bottom and top plan views of a right hand glove in accordance with the preferred embodiment of the invention.

Referring now to the drawings and more particularly to FIG. 1, reference numeral 10 denotes a piece of fruit, and more particularly, an apple which is being picked from a tree, not shown, by a picker, also not shown, who is wearing a glove 12 in accordance with the subject invention on his right hand and is gripping the apple in a typical pincer movement between the thumb and the four opposing fingers. During the hand picking of an apple, the pressure exerted on the fruit by the picker's thumb and the middle three fingers has been found to damage the fruit by the bruising thereof, which sometimes does not manifest itself until it reaches the market. In order to remedy this problem and to provide a high yield of marketable product free of bruises, an apple picker would wear one or a pair of gloves in accordance with this invention, the right hand glove being illustrated in FIGS. 2A and 2B, while the left hand glove is illustrated in FIGS. 4A and 4B.

Figure 4B:
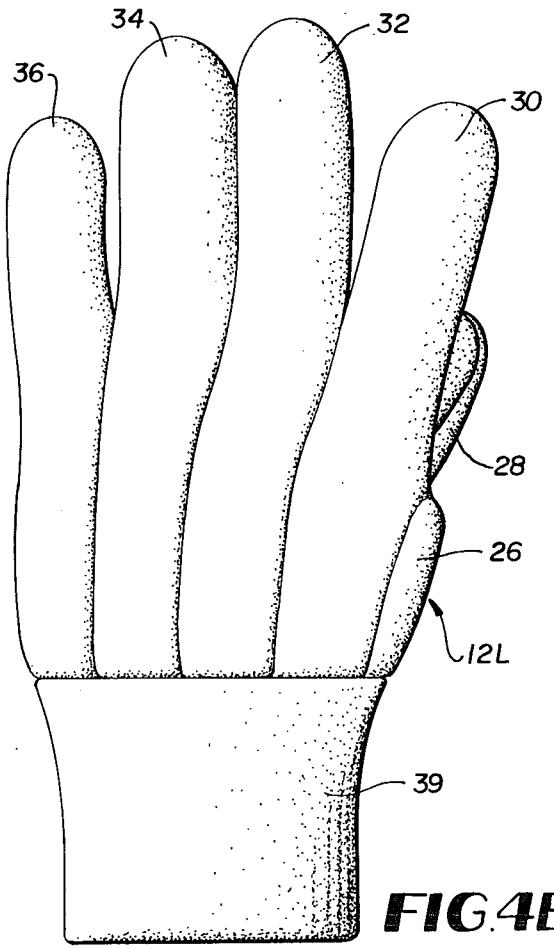
FIGS. 4A and 4B are illustrative of bottom and top plan views of a left hand glove in accordance with the preferred embodiment of the invention.
Figure 4A:
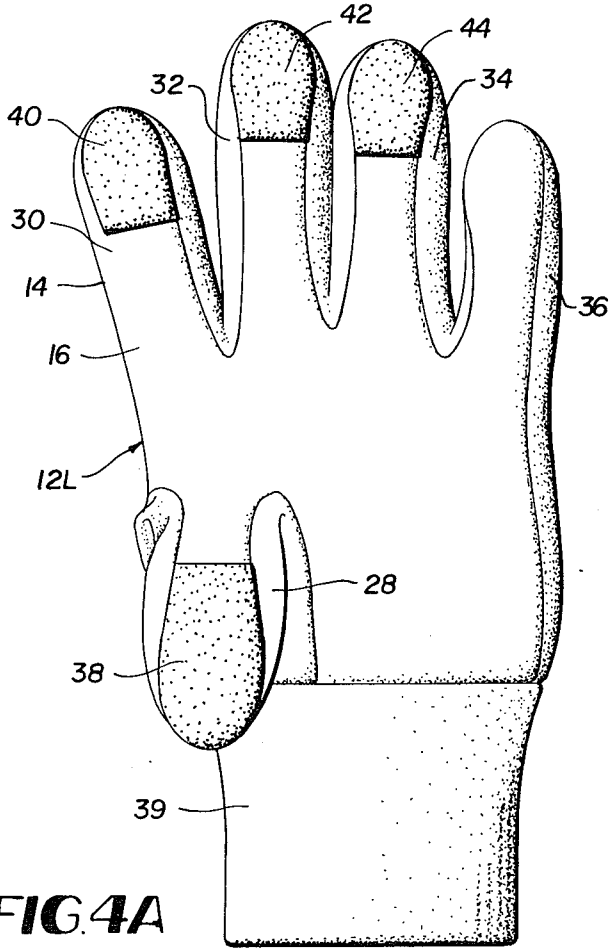
Figure 3:
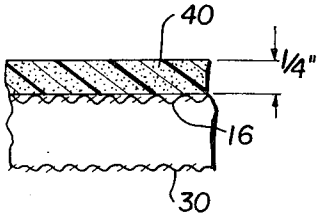
FIG. 3 is a partial cross sectional view taken along the lines 3—3 of FIG. 2A.

Considering the right hand glove $\mathbf{12}_R$ as shown in FIGS. 2A and 2B, for purposes of illustration, and noting that the left hand glove $\mathbf{12}_L$ as shown in FIGS. 4A and 4B is identical thereto in construction, the glove $\mathbf{12}_R$ includes a hand covering glove body 14 comprised of soft material, such as jersey, and is comprised of a palm section 16 (FIG. 2A) and a plurality of back hand section 18, 20, 22, 24 and 26 (FIG. 2B) which are sewn together to provide a thumb stall 28 and four finger stalls 30, 32, 34 and 36. A cuff 38, comprised of elastic material and adapted to engage the wrist of the wearer, is sewn to the glove body 14 at the opposite end from the thumb and finger stalls. Such a configuration is conventional with the exception that in the present invention the material from which the glove body is made comprises a soft fabric so as not to scratch or otherwise exteriorally damage the surface of the fruit, i.e. apple 10 during a hand picking operation.

Additionally and most importantly, the fruit picking glove in accordance with this invention includes a set of foam rubber pads shown by reference numerals 38, 40, 42 and 44 which are secured to the fabric of the palm section 16 of the thumb stall 28 and the three inner finger stalls 30, 32 and 34 for the second, third, and digit of the wearer's hand, the thumb being the first digit. The pads are typically 0.25 in. in thickness, however, they can be made thinner or thicker as desired as long as a proper feel for the fruit being picked can be maintained. When desirable, a foam rubber pad element can also be applied to the palm surface of the finger stall 36 for the fifth digit (little finger). In practice, it has been found that it can be deleted inasmuch as pressure tending to bruise the fruit, i.e. apples during a hand picking harvesting operation, comes from the thumb, forefinger, middle finger and next to last finger of the hand i.e. digits 1, 2, 3, and 4.

Further as shown, the pads 38, 40, 42 and 44 are rounded at their outer extremities so as to conform to the shape of the finger stall ends and cover the tips of the wearer's fingers when inserted into the glove. Furthermore, the pads 40, 42 and 44 of the three finger stalls have a length such that they extend inwardly of the wearer's hand to the region of the finger joint intermediate the distal and medial phalanges to thereby provide a cushion for the pressure exerted by the distal phalanges of the second, third and fourth digits of the hand. With respect to the pad 38, however, it extends beyond the knuckle joint intermediate the distal and proximal phalanges so that the cushion is provided for substantially all of the pressure exerted by the distal and proximal phalanges of the first digit or thumb. When desirable, the pad 38 can extend back to the joint between the proximal phalanx and the lateral metacarpal bone of the hand.

Thus what has been shown and described is a work glove particularly adapted for the hand picking of fruit, particularly apples, from a tree during harvest time without bruising the fruit, yet providing the necessary feel so that the fruit can be picked quickly and easily.

Having thus shown and described what is at present considered to be the preferred embodiment of the invention, it should be noted that the same has been made by way of illustration and not limitation. Accordingly, all alterations, changes and modifications coming within the spirit and scope of the invention as set forth in the appended claims are herein meant to be included.

What is claimed is:

1. A work glove for the harvesting of fruit, particularly apples, comprising:

a glove body of a relatively soft fabric including a thumb stall and a plurality of finger stalls; and pads of relatively soft compressible material located on the inside forward end portions of the thumb stall and a selected number of finger stalls for compensating for the thumb and finger pressure exerted on the fruit which causes bruising of the fruit during a hand picking harvesting operation, wherein said plurality of finger stalls includes finger stalls for the second, third and fourth digits of the hand and corresponding to the forefinger, middle finger and next to last finger, respectively, wherein said pads for said selected number of said finger stalls only comprises pads for the finger stalls for the second, third and fourth digits of a wearer's hand, and wherein said plurality of finger stalls additionally includes a finger stall for the fifth digit or little finger of the hand, said finger stall for the fifth digit being devoid of a said pad.

2. The work glove as defined by claim 1 wherein said relatively soft compressible material of said pad comprises foam rubber material.

3. The work glove as defined by claim 2 wherein said foam rubber material has a thickness of substantially 0.25 in.

4. The work glove as defined by claim 1 wherein said pads on said finger stalls for the second, third and fourth digits have rounded end portions and extend from the distal end of the finger stall inwardly to cover only the distal phalanx of a wearer's finger and wherein the pad on the thumb stall includes a rounded end portion and extends from the distal end of the thumb stall to cover only the distal phalanx and at least a portion of the proximal phalanx of the wearer's thumb.

5. The work glove as defined by claim 4 wherein the inward ends of said pads for the finger stalls for the second, third and fourth digits stops at the region of the joint intermediate the distal and medial phalanges of the wearer's fingers.

6. The work glove as defined by claim 5 wherein the pad of the thumb stall extends and stops substantially mid-way of the proximal phalanx of the wearer's thumb.

7. The work glove as defined by claim 6 wherein said soft compressible material of said pads comprises a foam rubber material and wherein said soft fabric of said glove body is comprised of a jersey type of fabric.

8. The work glove as defined by claim 7 wherein said foam rubber material is substantially 0.25 in. in thickness and wherein said jersey material typically comprises 6 oz. jersey material.

* * * * *